US010655432B2

(12) United States Patent
Bowley et al.

(10) Patent No.: US 10,655,432 B2
(45) Date of Patent: May 19, 2020

(54) SELF-CLEANING SAND SCREEN

(71) Applicant: ENERCORP SAND SOLUTIONS INC., Calgary (CA)

(72) Inventors: Ryan Thomas Bowley, Calgary (CA); Rory Nagge, Calgary (CA)

(73) Assignee: ENERCORP SAND SOLUTIONS INC., Calgary, Alberta (CA)

( * ) Notice: Subject to any disclaimer, the term of this patent is extended or adjusted under 35 U.S.C. 154(b) by 0 days.

(21) Appl. No.: 16/032,603

(22) Filed: Jul. 11, 2018

(65) Prior Publication Data

US 2019/0017351 A1 Jan. 17, 2019

Related U.S. Application Data

(60) Provisional application No. 62/531,483, filed on Jul. 12, 2017.

(51) Int. Cl.

| | |
|---|---|
| ***E21B 37/08*** | (2006.01) |
| ***E21B 43/34*** | (2006.01) |
| ***B07B 1/22*** | (2006.01) |
| ***B07B 1/46*** | (2006.01) |
| ***B07B 1/55*** | (2006.01) |
| ***E21B 43/08*** | (2006.01) |
| ***B07B 1/50*** | (2006.01) |
| *E21B 43/26* | (2006.01) |

(52) U.S. Cl.

CPC ..... *E21B 37/08* (2013.01); *B07B 1/22* (2013.01); *B07B 1/469* (2013.01); *B07B 1/50* (2013.01); *B07B 1/55* (2013.01); *E21B 43/08* (2013.01); *E21B 43/34* (2013.01); *E21B 43/26* (2013.01)

(58) Field of Classification Search

CPC ..... E21B 37/08; E21B 43/08; E21B 43/34; E21B 43/26; B07B 1/50; B07B 1/22; B07B 1/469; B07B 1/55; B01D 29/606; B01D 29/603

USPC ..... 210/741, 739

See application file for complete search history.

(56) References Cited

U.S. PATENT DOCUMENTS 2,184,177 A 12/1939 Burrell
3,511,374 A 5/1970 Beal
(Continued)

OTHER PUBLICATIONS

Author Unknown, AutoFilt® RF3 Automatic Self-Cleaning Filter, HYDAC International Solutions, HYDAC Technology Corporation, 2008, pp. 1-8.

(Continued)

*Primary Examiner* — David J Bagnell
*Assistant Examiner* — Yanick A Akaragwe
(74) *Attorney, Agent, or Firm* — MH2 Technology Law Group LLP

(57) ABSTRACT

An apparatus for removing sand from a well fluid includes a pressure vessel having an inlet and an outlet. The well fluid flows into the pressure vessel through the inlet and flows out of the pressure vessel through the outlet. A screen is positioned at least partially within the pressure vessel and configured to remove the sand from the well fluid. At least a portion of the sand that is removed from the well fluid at least partially obstructs one or more openings in the screen. A cleaning assembly is positioned at least partially between the pressure vessel and the screen and configured to remove the sand that is obstructing the one or more openings in the screen during a screen-cleaning operation.

18 Claims, 13 Drawing Sheets

(56) References Cited

U.S. PATENT DOCUMENTS

| | | | | | |
|---|---|---|---|---|---|
| 3,985,656 | A * | 10/1976 | Arvanitakis | B01D 29/41 | 210/327 |
| 4,284,500 | A | 8/1981 | Keck | | |
| 5,160,428 | A * | 11/1992 | Kuri | B01D 29/118 | 210/107 |
| 5,268,095 | A * | 12/1993 | Barzuza | B01D 29/01 | 210/143 |
| 5,979,304 | A * | 11/1999 | Norais | B01D 29/05 | 100/37 |
| 9,816,282 | B2 * | 11/2017 | Chick | E04H 4/1245 | |
| 2003/0102268 | A1 * | 6/2003 | Prater | B01D 35/143 | 210/741 |
| 2015/0292313 | A1 * | 10/2015 | Morin | E21B 43/34 | 166/267 |

OTHER PUBLICATIONS

Author Unknown, ISF Self Cleaning Screen, LAKOS, http://www.lakos.com/industrial-products/isf-self-cleaning-screen, accessed Jul. 5, 2018, pp. 1-3.

Author Unknown, Self-Cleaning Filtration, Brooks/Brooks, Spraying, Pumping, Filtering and Valves, http://www.johnbrooks.ca/products/filtering/self-cleaning-filtration/, accessed Jul. 5, 2018, pp. 1-2.

Marcus N. Allhands et al., "Removing Solids with Automatic Self-Cleaning Filters", The 15th Annual Produced Water Seminar, Jan. 19-21, 2005, pp. 1-9.

Author Unknown, Self-Cleaning Screen Filters, LAKOS, http://www.lakos.com/products/self-cleaning-screen-filters, accessed Jul. 11, 2018, pp. 1-2.

* cited by examiner

SELF-CLEANING SAND SCREEN

CROSS-REFERENCE TO RELATED APPLICATIONS

This application claims priority to U.S. Provisional Patent Application No. 62/531,483, filed on Jul. 12, 2017, the entirety of which is incorporated by reference.

BACKGROUND

Sand is found in oil, gas, and water being produced from active wells. The sand can originate in the formation itself or be introduced into the formation during the hydraulic fracturing of the well (e.g., as proppant sand). The sand causes damage to the well site equipment and pipe line, and, therefore, many jurisdictions require sand control. Oil and gas wells are increasingly utilizing sand separators such as screens/filters.

One way to ensure that sand of a certain size is being captured is to employ a sand screen (also known as a sand filter). The sand screen is a device that has slots or holes of a certain size so that no particles larger than that slot width can pass through the device. The device is not well-suited for bulk sand removal because the screen tends to plug-up when the fluid includes large amounts of sand. As such, these devices are often employed in series or after another type of bulk removal device such as a sedimentation unit. The primary devices work well at removing most of the sand but lose effectiveness as they fill/plug-up with sand.

As particles plug the slots of the sand screen, and the flow becomes restricted, the differential pressure caused by the filter increases. As a result, production can ultimately decrease. In many cases, paraffin waxes, that are not removed by the initial stage separator, add to the problem. To reverse these effects, the flow is shut-off to the unit, and the filters are removed and manually cleaned by workers. The disassembly, filter removal, washing, and reassembly is a time-consuming and labor-intensive task and has significant danger due to trapped sour gas. Therefore, there is a need for an automated solution of cleaning the sand filters.

SUMMARY

An apparatus for removing sand from a well fluid is disclosed. The apparatus includes a pressure vessel having an inlet and an outlet. The well fluid flows into the pressure vessel through the inlet and flows out of the pressure vessel through the outlet. A screen is positioned at least partially within the pressure vessel and configured to remove the sand from the well fluid. At least a portion of the sand that is removed from the well fluid at least partially obstructs one or more openings in the screen. A cleaning assembly is positioned at least partially between the pressure vessel and the screen and configured to remove the sand that is obstructing the one or more openings in the screen during a screen-cleaning operation.

In another embodiment, the apparatus includes a pressure vessel having an inlet and an outlet. The well fluid flows into the pressure vessel through the inlet and flows out of the pressure vessel through the outlet. A screen is positioned at least partially within the pressure vessel. The screen is substantially cylindrical and has a central longitudinal axis extending therethrough. The screen is configured to remove the sand from the well fluid. At least a portion of the sand that is removed from the well fluid at least partially obstructs one or more openings in the screen. A cleaning assembly is positioned at least partially between the pressure vessel and the screen. The cleaning assembly includes a power device configured to rotate the screen about the central longitudinal axis. The cleaning assembly also includes a spray nozzle that is configured to spray a washing fluid radially-inward onto the outer surface of the screen as the power device rotates the screen.

A method of removing sand from a screen disposed in a pressure vessel is also disclosed. The method includes causing a well fluid to flow into the pressure vessel. A screen in the pressure vessel removes the sand from the well fluid. At least a portion of the sand that is removed from the well fluid at least partially obstructs one or more openings in the screen. The method also includes removing the sand from the screen using a cleaning assembly that is positioned at least partially between the pressure vessel and the screen. The method also includes rotating the screen about a central longitudinal axis that extends therethrough as the sand is removed from the screen.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
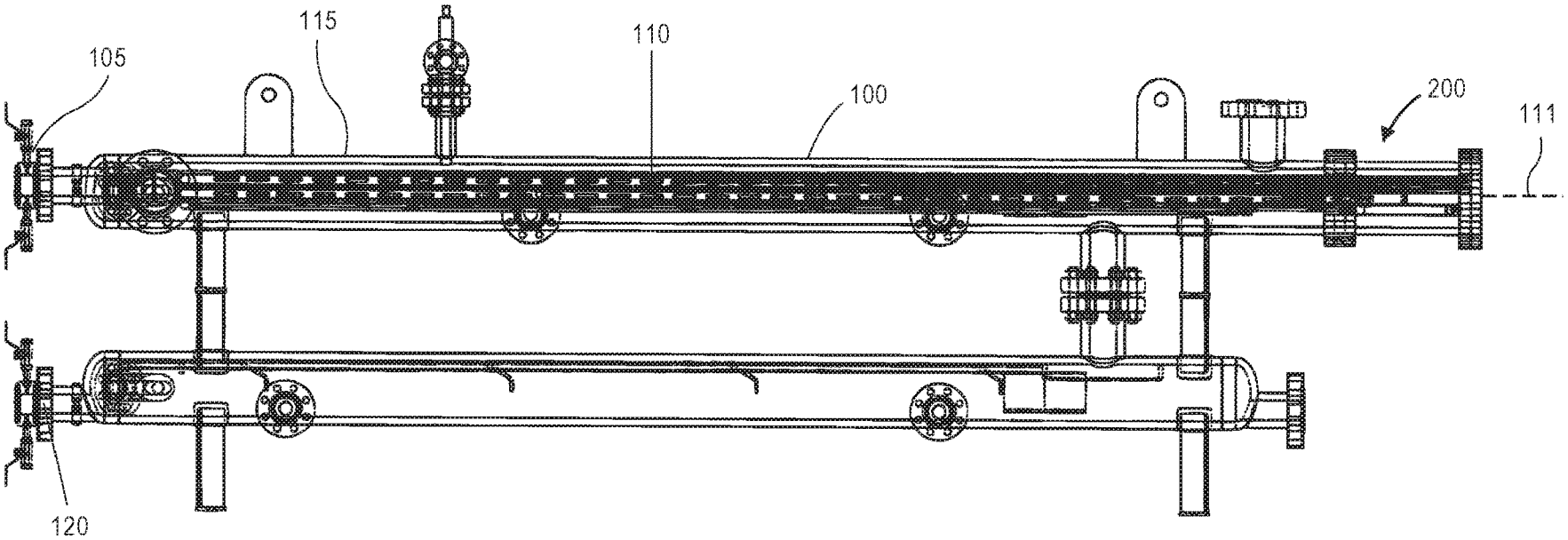
FIG. 1 illustrates a cross-sectional side view of a sand screen assembly with a self-cleaning assembly in a horizontal orientation, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure provide an apparatus for a self-cleaning sand filtration device. Turning now to the specific, illustrated embodiments, FIG. 1 illustrates a cross-sectional side view of a sand screen assembly 100 with a self-cleaning assembly 200 in a horizontal orientation. The sand screen assembly 100 includes a pressure vessel 115 that is configured to house a screen 110. The pressure vessel 115 may be configured to withstand pressures from about 1000 psi to about 10,000 psi (e.g., 3000 psi to about 5000 psi).

The sand screen assembly 100 further includes an inlet 120 and an outlet 105. As shown, the screen 110 is disposed between the inlet 120 and the outlet 105. The screen 110 is configured to block, separate, or otherwise remove particles (e.g., sand) from a fluid that flows into the inlet 120. The fluid may be a well fluid including oil, gas, water, or a combination thereof (e.g., from a well in a subterranean formation). The fluid may have a pressure from about 1000 psi to about 10,000 psi (e.g., 3000 psi to about 5000 psi). Once the particles have been removed from the fluid, the now-clean fluid, may flow out of the outlet 105. In one embodiment, the screen 110 is a hollow, cylindrical-shaped screen. The screen 110 may be similar to the screen described in U.S. Patent Publication No. 2015/0292313, which is incorporated herein by reference. As described in greater detail below, the self-cleaning assembly 200 may be positioned at least partially within the pressure vessel 115 and be configured to clean the screen 110 (e.g., remove particles from the screen 110) while positioned at least partially within the pressure vessel 115.

Figure 2:
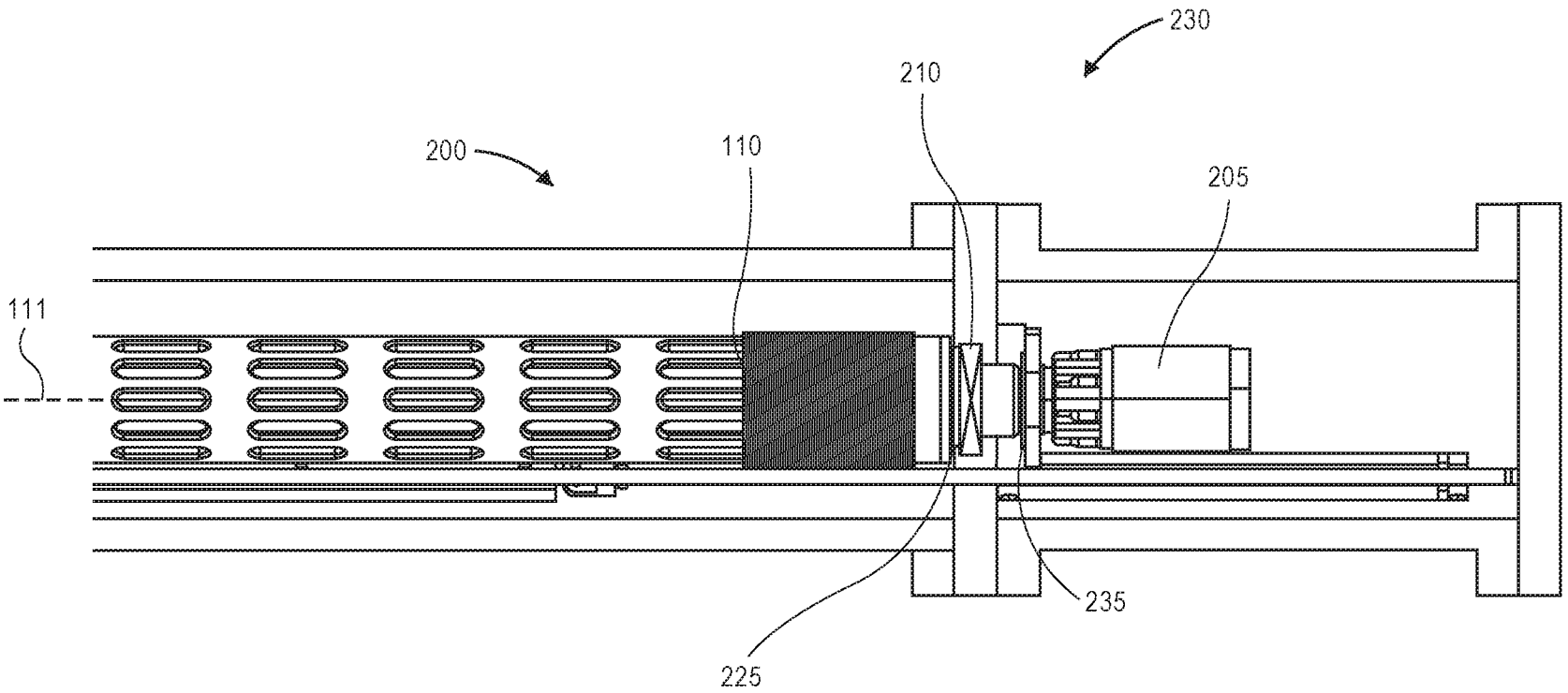
FIG. 2 illustrates a cross-sectional side view of a power section of the self-cleaning assembly, according to an embodiment.

FIG. 2 illustrates a cross-sectional side view of a power section 230 of the self-cleaning assembly 200. The power section 230 includes a power device 205, such as a hydraulic motor, an electric motor, or a rotary actuator. The power device 205 is configured to rotate the screen 110 along/around a central longitudinal axis 111 that extends through the (e.g., cylindrical) screen 110. The power section 230 further includes a bearing member 210 that is configured to maintain alignment between a screen coupling 225 and a power coupling 235, while allowing the screen 110 to rotate with respect to the pressure vessel 115.

Figure 3:
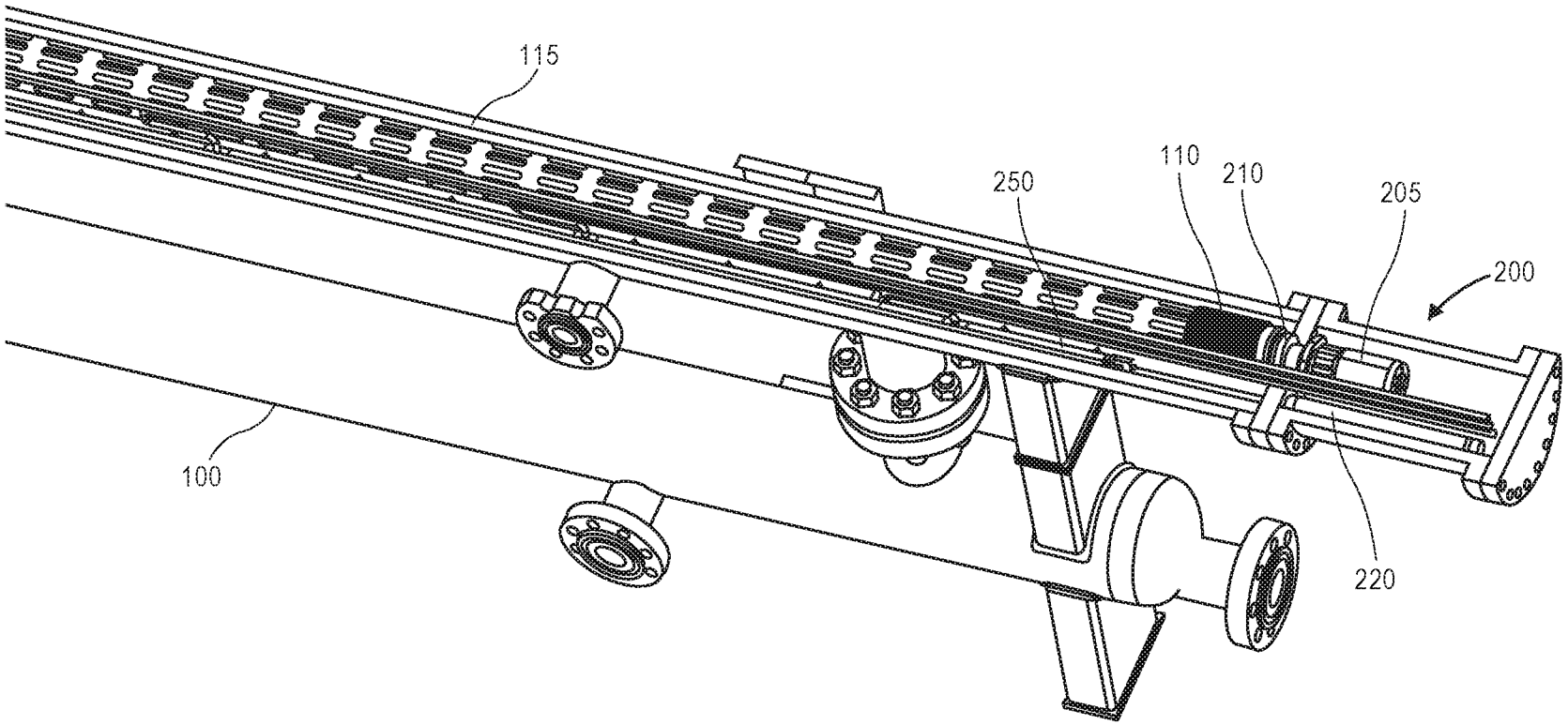
FIG. 3 illustrates a perspective view of the self-cleaning assembly, according to an embodiment.

FIG. 3 illustrates a perspective view of the self-cleaning assembly 200 in the sand screen assembly 100. The self-cleaning assembly 200 includes a cleaning device 250 positioned adjacent to the screen 110. The cleaning device 250 is configured to clean the screen 110 (e.g., as the screen 110 is rotated by the power device 205). The self-cleaning assembly 200 includes an optional linear actuator 220 that moves the cleaning device 250 in a linear/axial direction that is parallel to the central longitudinal axis 111 extending through the screen 110. In other words, the cleaning device 250 may be reciprocated back and forth along an exterior surface of the screen 110 as the screen 110 is rotated by the power device 205. In one embodiment, the linear actuator 220 is a hydraulic cylinder or a pneumatic cylinder. In another embodiment, the linear actuator 220 is a rotating screw drive. In yet another embodiment, the cleaning device 250 does not move relative to the screen 110 in the linear/axial direction.

In the embodiment shown in FIG. 3, the cleaning device 250 is a spray nozzle assembly. During a screen-cleaning operation, the spray nozzle assembly is configured to spray a washing fluid, such as water, anti-freeze, cleaner-degreaser, etc. on the exterior surface of the screen 110 to clean/remove the particles that are on and/or in the screen 110. In other embodiments, the cleaning device 250 may be linear brush and/or a linear scrapper that is/are configured to physically brush or scrape particles off of the screen 110.

Figure 4:
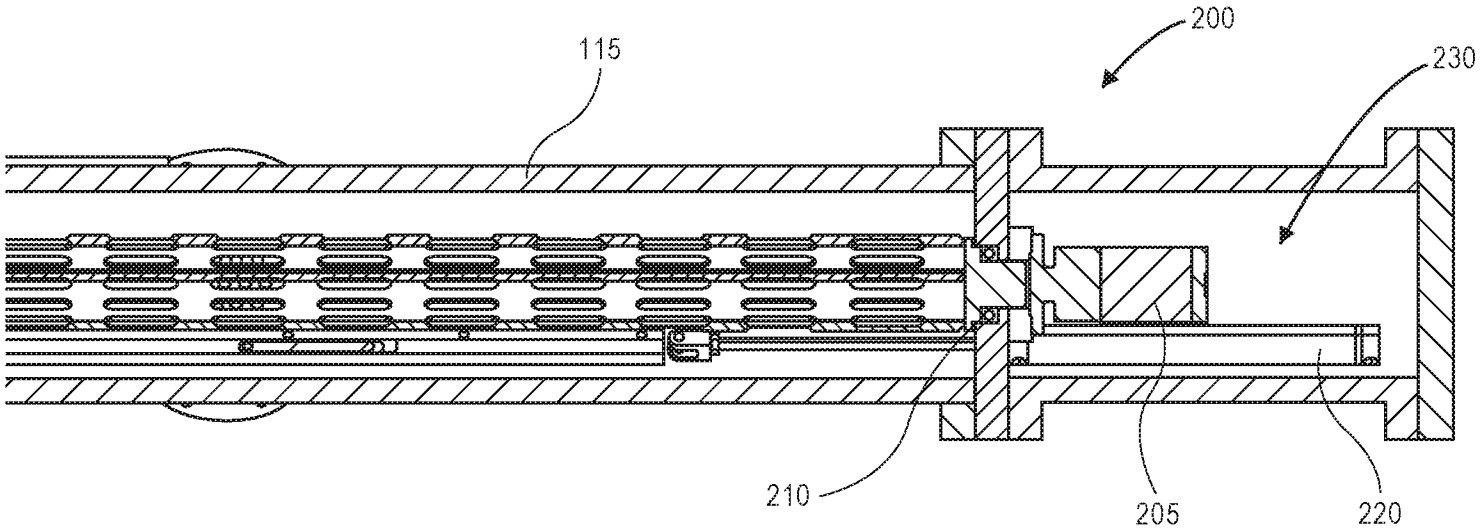
FIG. 4 illustrates a cross-sectional side view of the power section of the self-cleaning assembly, according to an embodiment.

FIG. 4 illustrates a cross-sectional side view of the power section 230 of the self-cleaning assembly 200. As shown, the linear actuator 220 is disposed adjacent the power device 205 of the power section 230.

Figure 5:
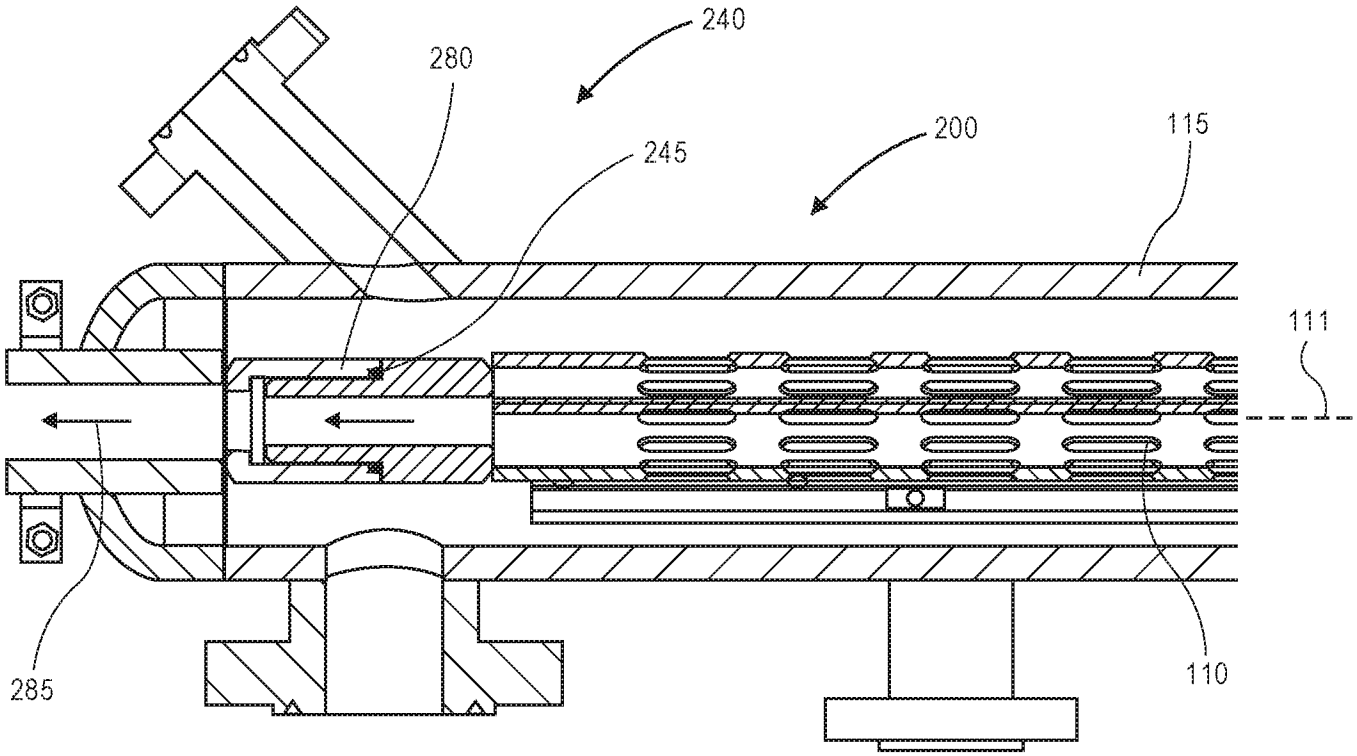
FIG. 5 illustrates a cross-sectional side view of a support section of the self-cleaning assembly, according to an embodiment.

FIG. 5 illustrates a cross-sectional side view of a support section 240 of the self-cleaning assembly 200. The support section 240 is configured to support an end of the screen 110 as the screen 110 rotates around its longitudinal axis 111. The support section 240 includes a bearing 280 (or bushing) that allows the screen 110 to be supported while rotating. The support section 240 further includes a seal member 245 disposed between the bearing 280 and the screen 110. The seal member 245 is configured to seal a fluid path between the bearing 280 and the screen 110 such that fluid (arrow 285) exits the screen 110 of the sand screen 100.

Figure 6:
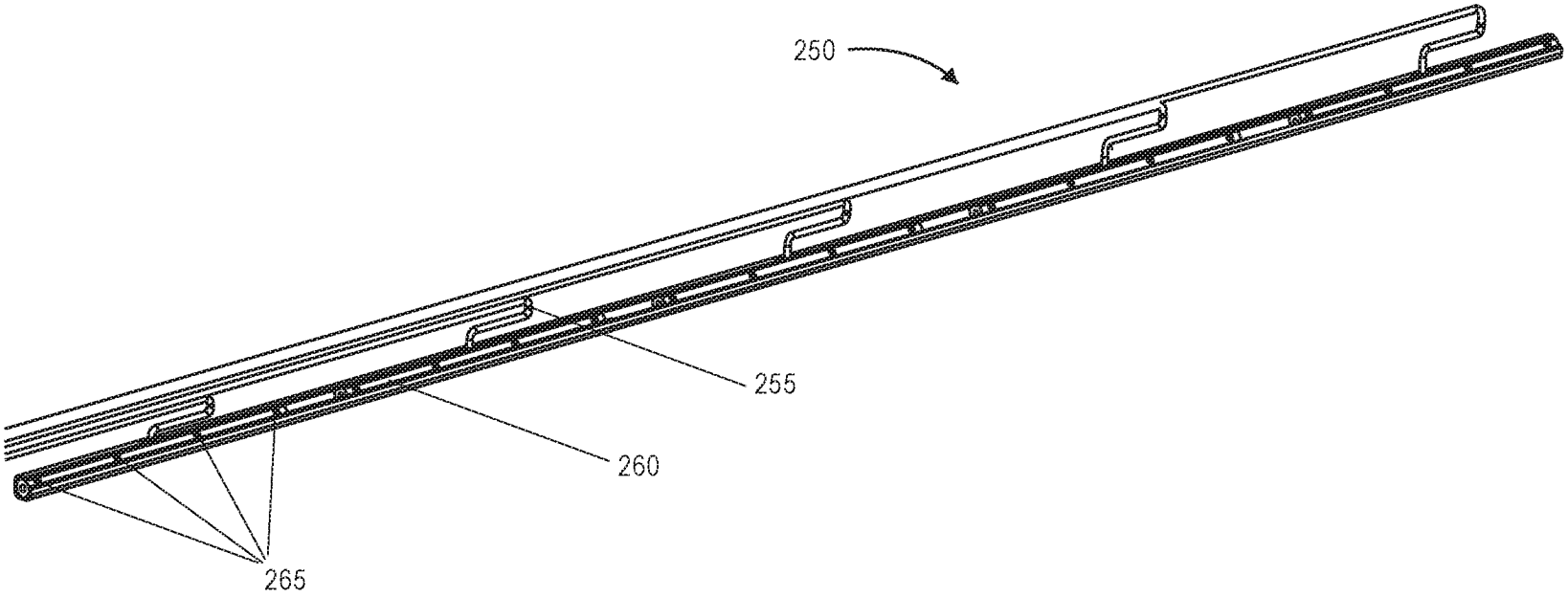
FIG. 6 illustrates a perspective view of a cleaning device of the self-cleaning assembly, according to an embodiment.

FIG. 6 illustrates a perspective view of the cleaning device 250 of the self-cleaning assembly 200. In the embodiment shown, the cleaning device 250 may be or include a spray nozzle assembly that is configured to spray the washing fluid on the exterior surface of the screen 110. The spray nozzle assembly includes a plurality of spray nozzles 265 connected to a nozzle manifold 260. The nozzle manifold 260 is connected to a manifold feed hose 255. The manifold feed hose 255 may be connected to a skid mounted water pump (not shown) which is configured to supply the washing fluid to the cleaning device 250.

Figure 7:
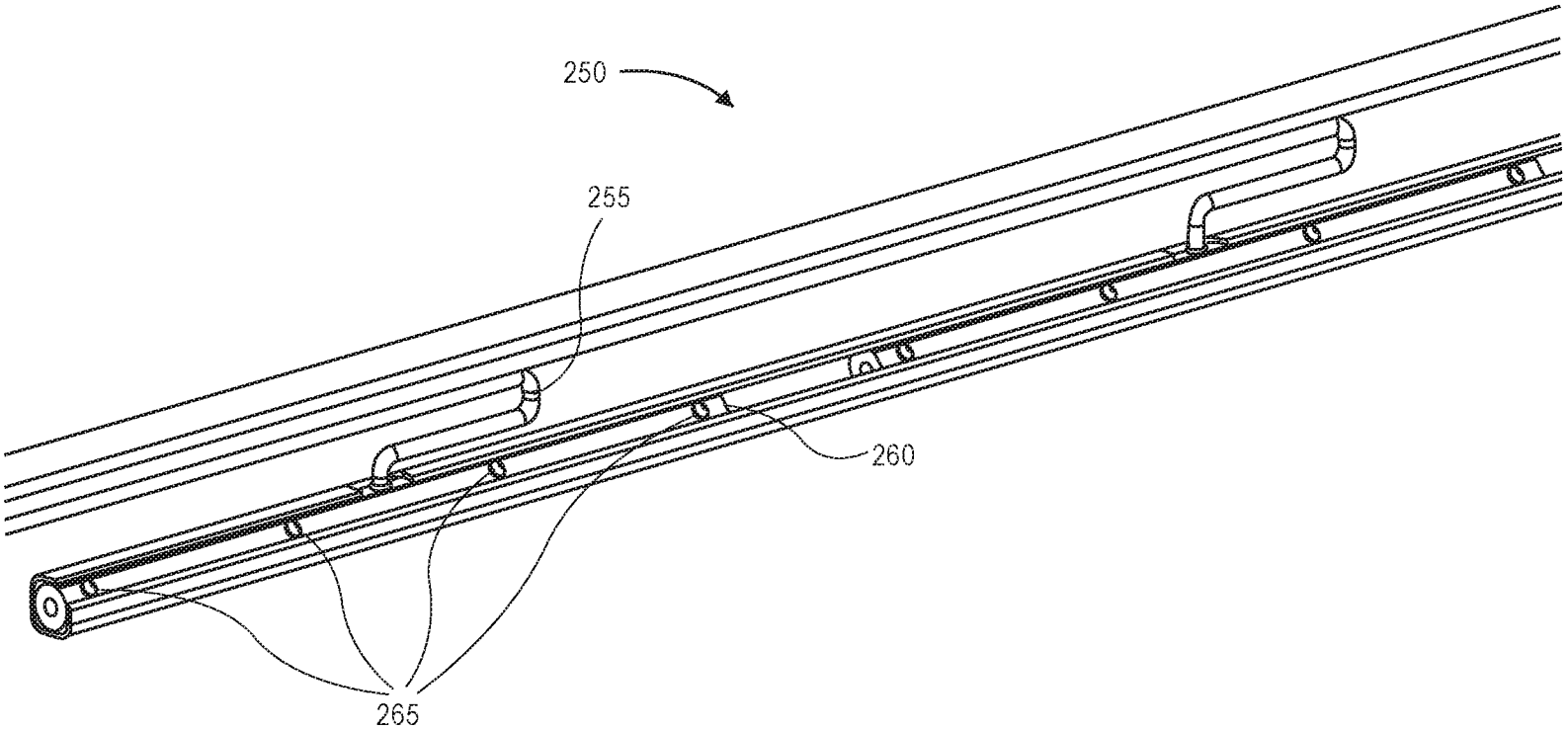
FIG. 7 illustrates an enlarged view of a nozzle manifold, according to an embodiment.

FIG. 7 illustrates an enlarged view of the nozzle manifold 260. In the embodiment shown, there are four spray nozzles 265 connected the nozzle manifold 260. In other embodiments, any number of spray nozzles 265 may be connected to the nozzle manifold 260 without departing from the present disclosure. Each nozzle manifold 260 is fed by the manifold feed hose 255 that runs to the exterior of the pressure vessel 115. A control valve (not shown) is attached to the cleaning device 250 and is configured to allow the first set of spray nozzles to spray for a predetermined time to ensure the linear actuator 220 has completed a full cycle (e.g., moving the cleaning device back and forth as described herein). The valve is then switched/actuated, and the next nozzle manifold is pressurized to spray for a predetermined amount of time to ensure the next portion of the screen is cleaned. The steps are repeated until the entire screen 110 is cleaned.

Figure 8:
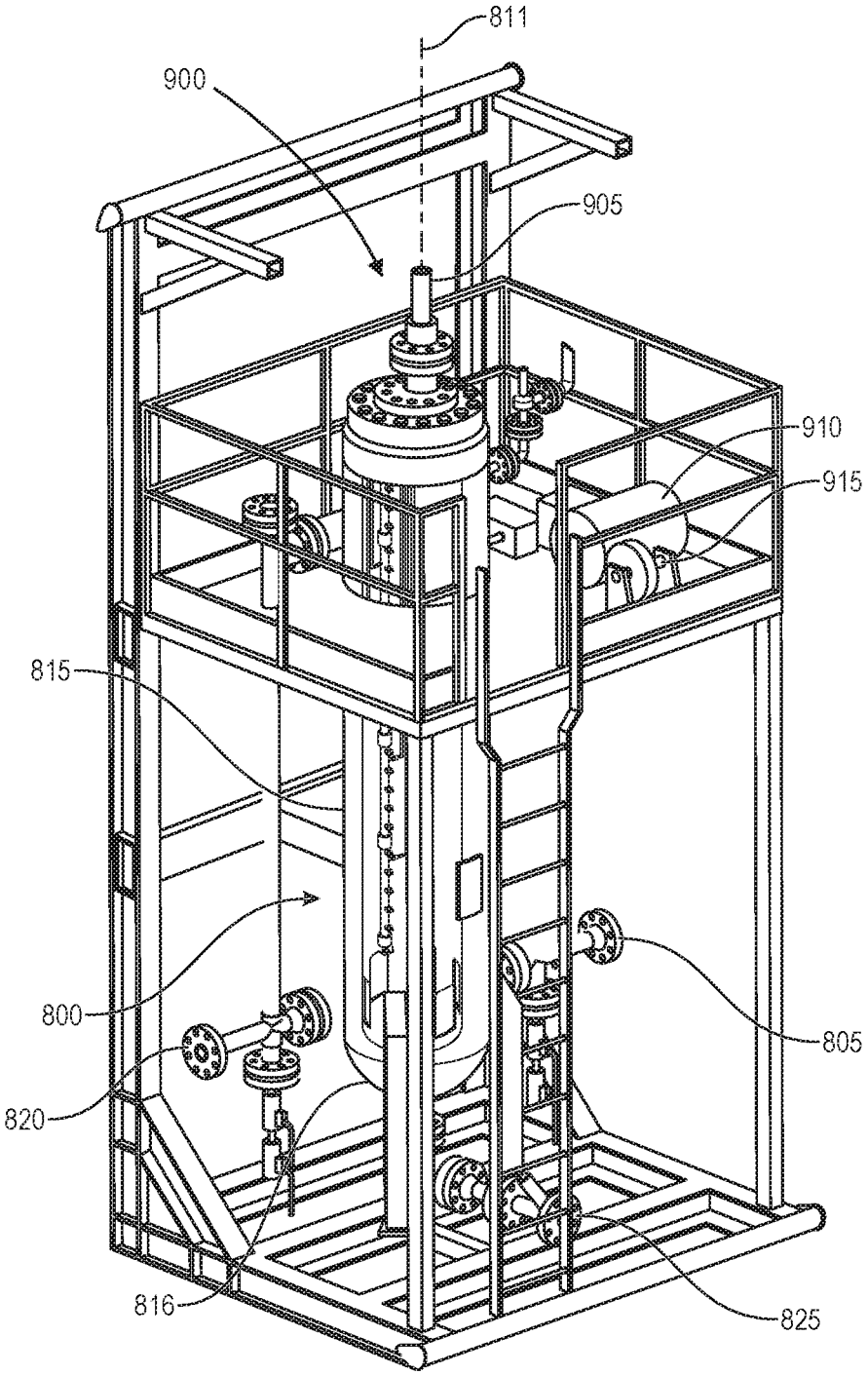
FIG. 8 illustrates a perspective view of another sand screen assembly with a self-cleaning assembly in a vertical orientation, according to an embodiment.

FIG. 8 illustrates a perspective view of another sand screen assembly 800 with a self-cleaning assembly 900 in a vertical orientation, according to an embodiment. The sand screen assembly 800 and/or the self-cleaning assembly 900 may be similar to the sand screen assembly 100 and/or the self-cleaning assembly 200, except the sand screen assembly 800 and/or the self-cleaning assembly 900 may be in a vertical orientation. In other words, a central longitudinal axis 811 through the sand screen assembly 800 and/or the self-cleaning assembly 900 may be vertical.

The sand screen assembly 800 may include a pressure vessel 815, an inlet 820, an outlet 805, and a drain 825. The self-cleaning assembly 900 may include a hydraulic motor 905, an electric motor 910, and a hydraulic pump 915.

The fluid with particles (e.g., sand) dispersed therein may flow into the pressure vessel 815 through the inlet 820. The fluid may then flow (e.g., radially) inward through the screen 810 (see FIG. 11), which is positioned inside the pressure vessel 815. Particles having a larger cross-section (e.g., diameter) than the openings in the screen 810 may be prevented from flowing (e.g., radially) inward through the screen 810. In at least one embodiment, the openings in the screen 810 may be 150 microns. Thus, the screen 810 may filter/clean the fluid. The now-clean fluid may flow axially through the screen 810 and exit the pressure vessel 815 through the outlet 805. At least a portion of the particles may descend through the annulus between the pressure vessel 815 and the screen 810 to a lower axial end 816 of the pressure vessel 815. However, a portion of the particles may become caked-onto the outer surface of the screen 810, plugging at least a portion of the openings in the screen 810. As described in greater detail below, the self-cleaning assembly 900 may remove the particles that are caked-onto the outer surface of the screen 810 so that these particles may also descend through the annulus between the pressure vessel 815 and the screen 810 to the lower axial end 816 of the pressure vessel 815.

When the particles are removed from the outer surface of the screen 110 in the sand screen assembly 100 by the self-cleaning assembly 200 shown in FIG. 1 (e.g., in the horizontal orientation), the particles may fall to the inner radial surface of the pressure vessel 115. This may mitigate the benefits of cleaning the screen 110, as the particles on the inner radial surface of the pressure vessel 115 may partially obstruct a relatively large portion of the screen 110. However, when the particles are removed from the outer surface of the screen 810 in the sand screen assembly 800 by the self-cleaning assembly 900 in FIG. 8 (e.g., in the vertical orientation), the particles may fall to the lower axial end 816 of the pressure vessel 815. This may result in only the lower end (and progressively more, as more sand is removed) of the screen 810 being obstructed by the sand, and thus less surface area when comparing equal amounts of sand.

Figure 9:
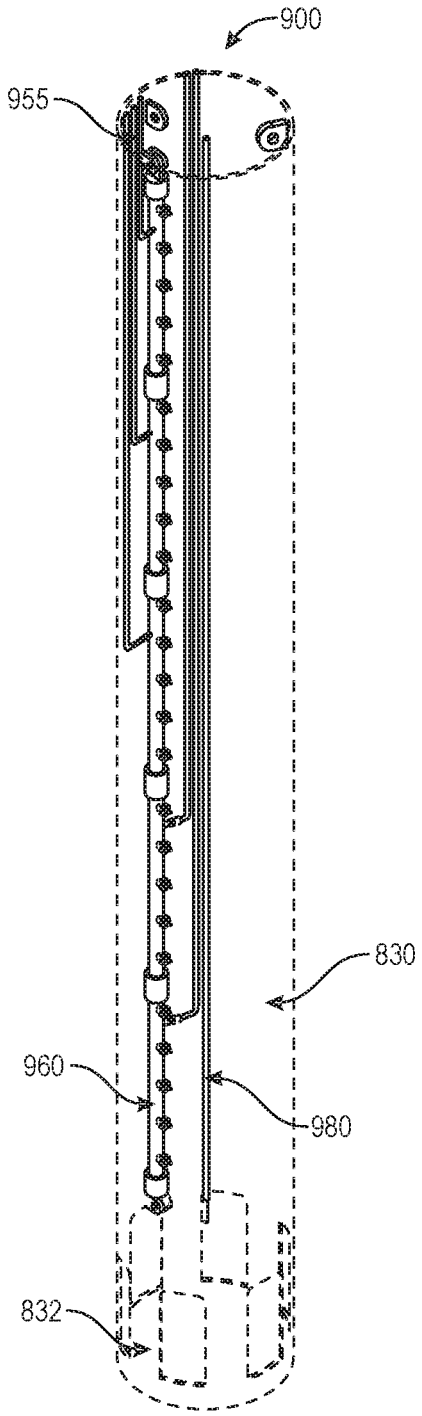
FIG. 9 illustrates a transparent perspective view of a portion of the sand screen assembly (e.g., a sand screen casing) with the self-cleaning assembly from FIG. 8, according to an embodiment.

FIG. 9 illustrates a transparent perspective view of a portion of a sand screen casing 830 with the self-cleaning assembly 900, according to an embodiment. The sand screen casing 830 may be positioned inside the pressure vessel 815, and the screen 810 may be positioned inside the sand screen casing 830. The fluid may flow through the inlet 820 of the pressure vessel 815 and through an inlet of the sand screen casing 830. In at least one embodiment, the orientation of the inlet 820 of the pressure vessel 815 and/or the inlet of the sand screen casing 830 may cause the fluid to have a centrifugal flow between the sand screen casing 830 and the screen 810, which may provide a centrifugal separation (e.g., cyclone) effect. In at least one embodiment, the sand screen casing 830 may be optional/omitted.

The self-cleaning assembly 900 may include a manifold feed hose (e.g., a supply tubing) 955 for supplying the washing fluid (e.g., water) to a nozzle manifold (e.g., a wash bar) 960. The self-cleaning assembly 900 may optionally include an auxiliary brush 980 that may physically brush/scrape the particles off of the outer surface of the screen 810, e.g., as the screen 810 is rotated with respect to the brush 980, the sand screen casing 830, and/or the pressure vessel 815. One or more openings 832 may be provided at a lower end of the sand screen casing 830 that provide a path of fluid communication from the main chamber to the screen 810.

Figure 10:
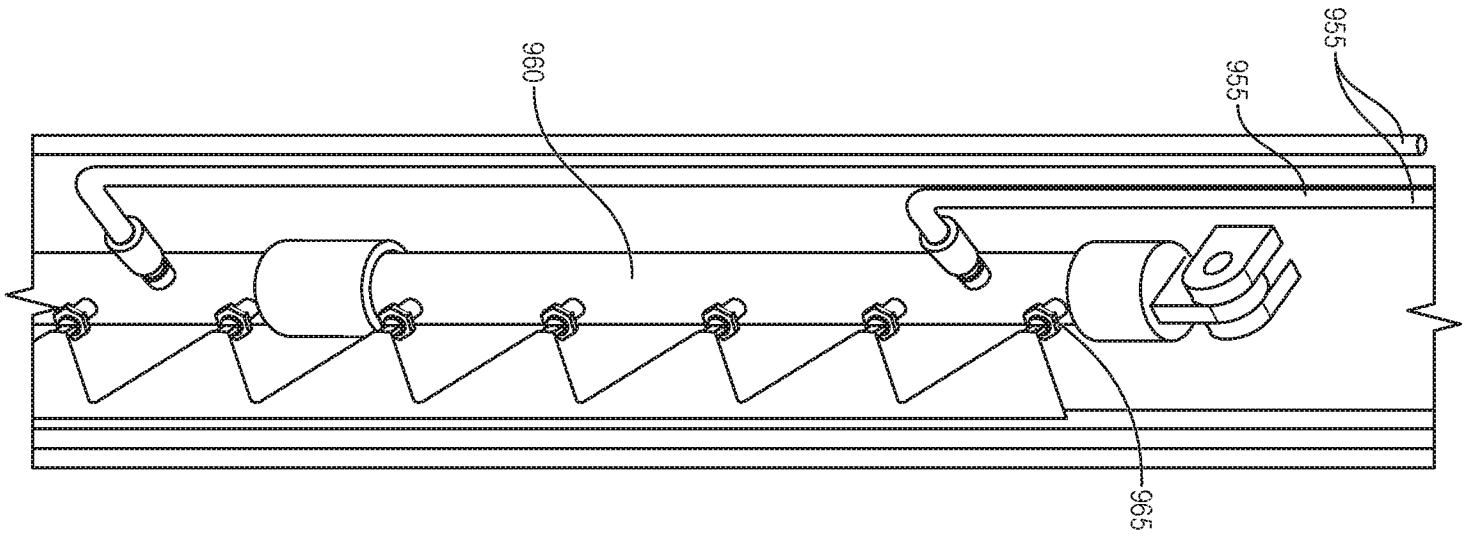
FIG. 10 illustrates a portion of the wash bar and nozzles from FIG. 9, according to an embodiment.

FIG. 10 illustrates a portion of the nozzle manifold 960, according to an embodiment. The nozzle manifold 960 may receive the washing fluid from the manifold feed hose 955 and then eject/spray the washing fluid out onto the outer surface of the screen 810 through one or more nozzles 965. The nozzles 965 may be axially offset from one another along the nozzle manifold 960.

Figure 11:
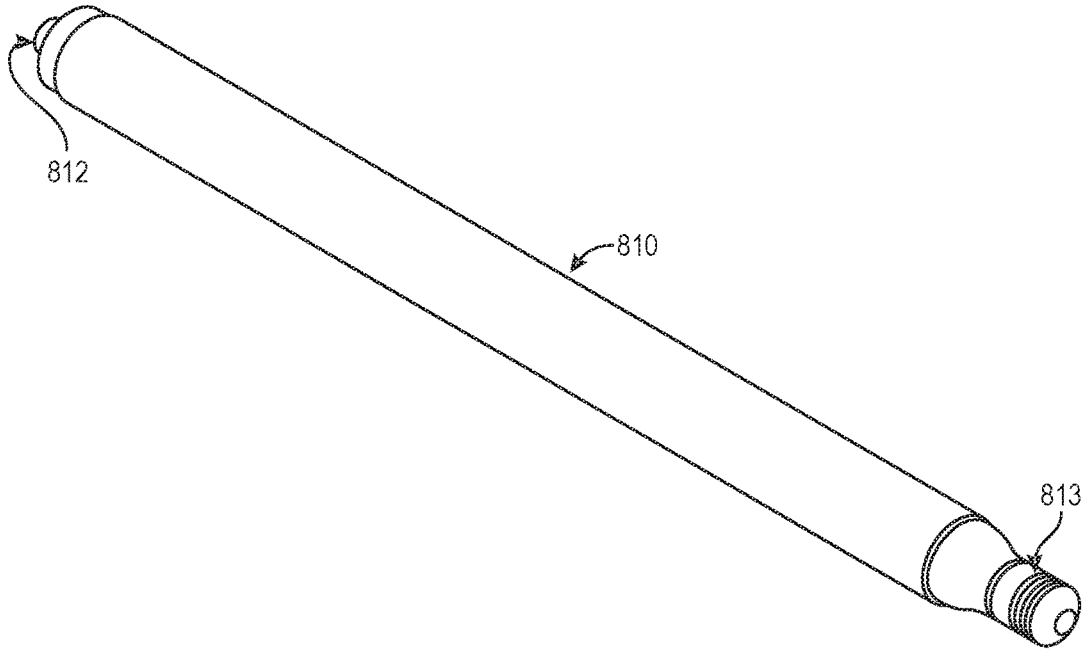
FIG. 11 illustrates a screen from the sand screen assembly with the self-cleaning assembly from FIG. 8, according to an embodiment.

FIG. 11 illustrates the screen 810, according to an embodiment. The screen 810 may be a tubular member (e.g., a pipe) with the openings formed radially therethrough. In at least one example, the screen 810 may have a 6 inch diameter; however, as will be appreciated other diameters/sizes may also be used without departing from the disclosure. The screen 810 may have a coupling 812 at a first (e.g., upper) axial end. The coupling 812 may be a female shaft coupling. The screen 810 may have an outlet with seals 813 at a second (e.g., lower) axial end.

Figure 12:
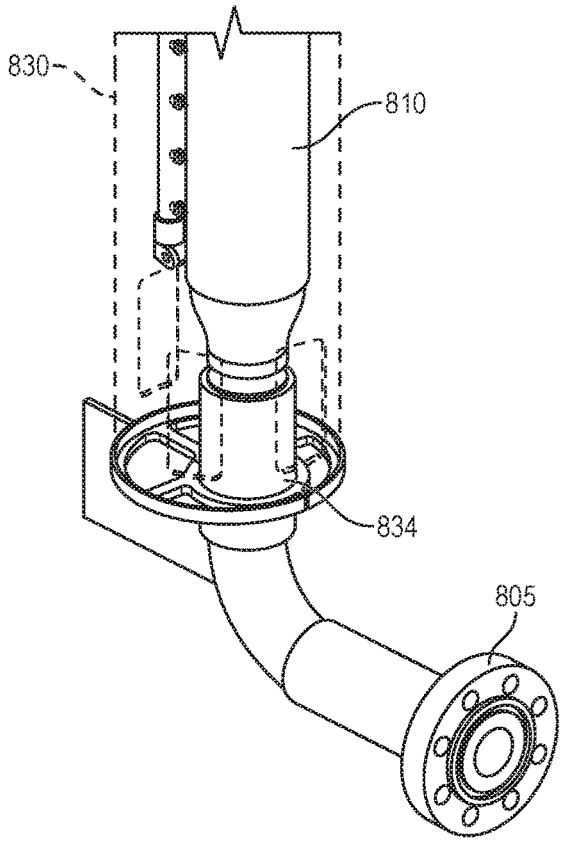
FIG. 12 illustrates the sand screen casing from FIG. 9 with the screen positioned therein, according to an embodiment.

FIG. 12 illustrates the sand screen casing 830 with the screen 810 positioned therein, according to an embodiment. An outlet 834 of the screen 810 and/or the sand screen casing 830 may be in communication with the outlet 805 of the sand screen assembly 800. The outlet 834 may be made from chrome to prevent seizing.

Figure 13:
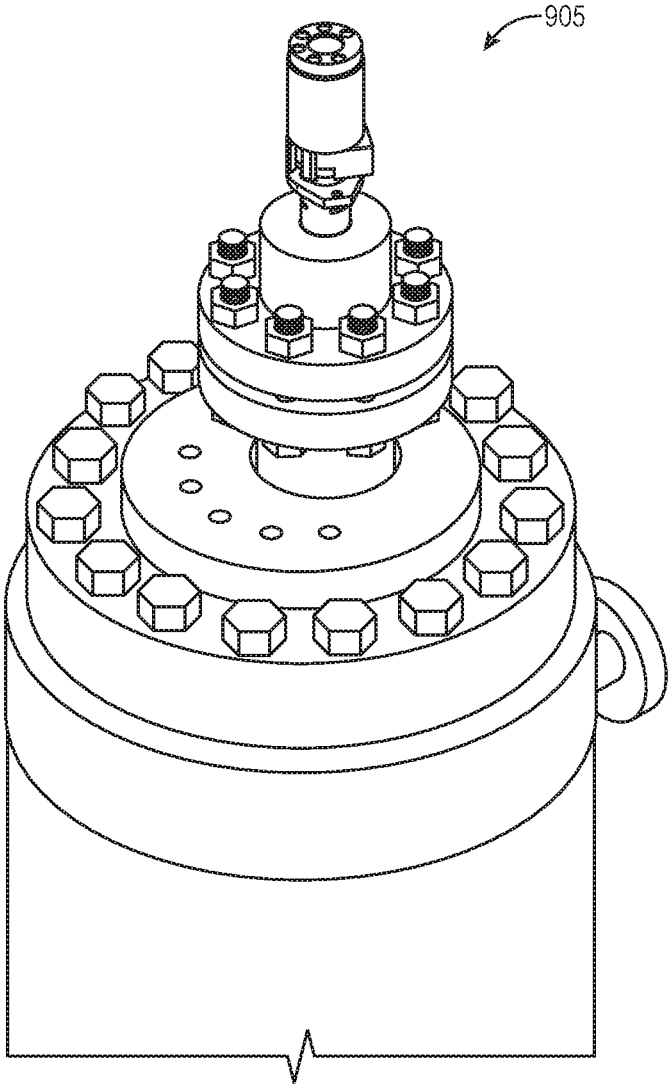
FIG. 13 illustrates a top head and motor assembly from the sand screen assembly with the self-cleaning assembly from FIG. 8, according to an embodiment.

FIG. 13 illustrates a top head and motor assembly 905 of the self-cleaning assembly 900, according to an embodiment.

Figure 14:
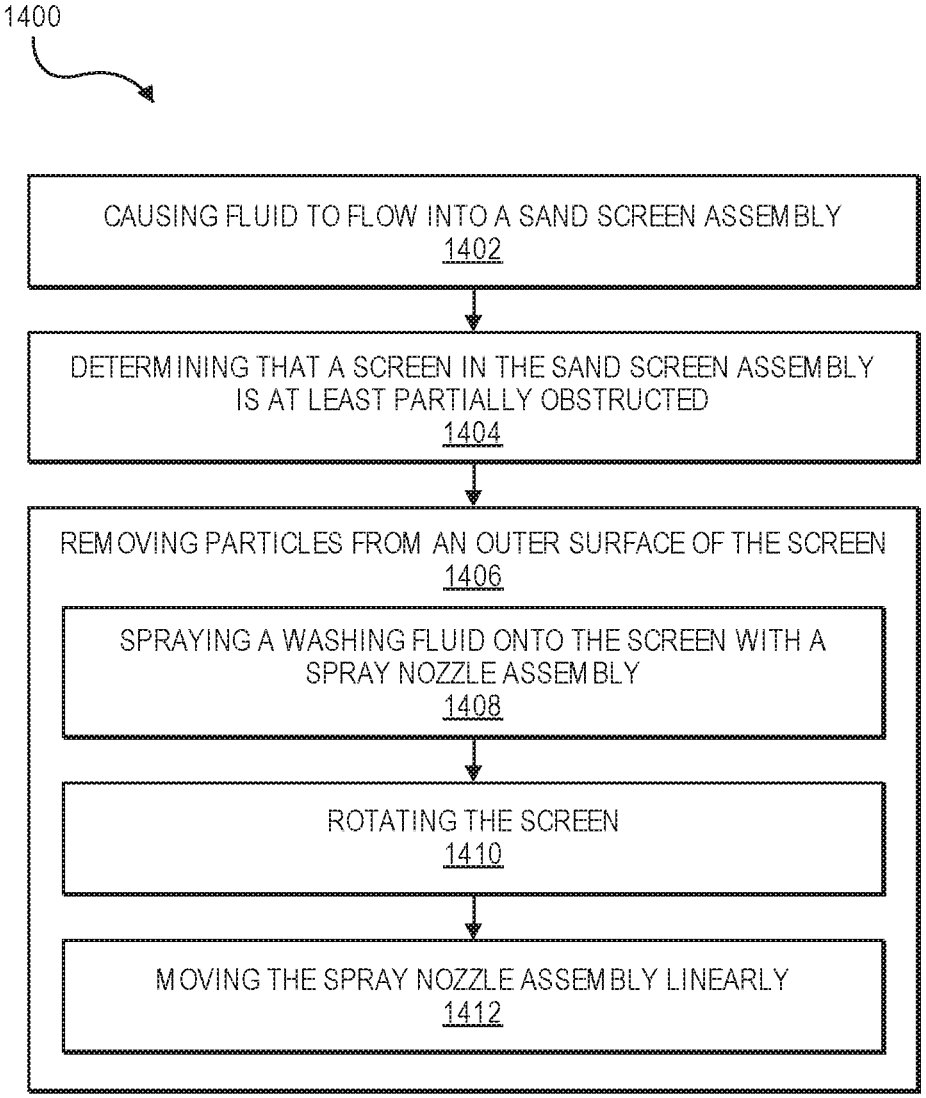
FIG. 14 illustrates a flowchart of a method for cleaning the sand screen using the self-cleaning assembly, according to an embodiment.

FIG. 14 illustrates a flowchart of a method 1400 for cleaning the sand screen 800 using the self-cleaning assembly 900, according to an embodiment. The method 1400 is described with reference to the sand screen 800 and the self-cleaning assembly 900 for simplicity; however, as will be appreciated, the method 1400 may also apply to the sand screen 100 and the self-cleaning assembly 200.

The method 1400 may include causing the fluid to flow into the sand screen 800 through the inlet 820, as at 1402. The user may cause the fluid to flow by, for example, actuating a valve that is in fluid communication with the inlet 820. The fluid may then flow into the pressure vessel 815 and subsequently radially-inward through the openings in the screen 810 in the pressure vessel 815. Particles with a dimension larger than the openings in the screen 810 may be separated/removed from the fluid by the screen 810 and remain in the annulus between the screen 810 and the pressure vessel 815. In at least one example, a first portion of the separated/removed particles may remain adhered to (e.g., caked-onto) the outer surface of the screen 810. The first portion of the separated/removed particles may plug or otherwise obstruct the openings in the screen 810. A second portion of the separated/removed particles may descend through the annulus to the lower end 816 of the pressure vessel 815 (e.g., due to gravity).

The method 1400 may also include determining that the screen is at least partially obstructed, as at 1404. In at least one embodiment, determining that the screen is at least partially obstructed may include measuring a pressure of the fluid. More particularly, one or more sensors may be used to measure the pressure of the fluid at the inlet 820 and the pressure of the fluid of the outlet 805 to determine the pressure drop therebetween. The screen 810 may be determined to be at least partially obstructed by the particles when the pressure drop exceeds a predetermined amount. In one example, the operating pressure of the fluid may be greater than or equal to about 500 psi (e.g., 3 ksi-10 ksi). In another embodiment, determining that the screen is at least partially obstructed may include measuring a volumetric flow rate. More particularly, one or more sensors may be used to measure the volumetric flow rate of the fluid at the inlet 820 and/or the outlet 805. The screen 810 may be determined to be at least partially obstructed by the particles when the volumetric flow rate drops below a predetermined amount.

The method 1400 may also include removing (e.g., the first portion of the) particles from the outer surface of the screen 810, as at 1406. The screen 810 may remain positioned within the pressure vessel 815 as the (e.g., first portion of the) particles are removed. Removing the (e.g., the first portion of the) particles may include spraying a washing fluid onto the outer surface of the screen with a spray nozzle assembly, as at 1408. More particularly, a valve may be actuated to cause the washing fluid to flow through the manifold feed hose 955, into the nozzle manifold 960, and out the nozzles 965. The washing fluid may be sprayed radially-inward from the nozzles 965 onto the outer surface of the screen 810.

In at least one embodiment, removing (e.g., the first portion of the) particles may also or instead include rotating the screen 810, as at 1410. More particularly, the hydraulic motor 905 and/or the electric motor 910 may rotate the screen 810 about the central longitudinal axis 811 that extends therethrough. This may help to ensure that the particles are removed all portions of the screen 810 (e.g., around the circumference).

In at least one embodiment, removing (e.g., the first portion of the) particles may also or instead include moving the nozzle manifold 960 within the pressure vessel 815, as at 1412. More particularly, the nozzle manifold 960 may be moved axially/longitudinally by the hydraulic pump 915 in a direction that is parallel to the central longitudinal axis 811 through the screen 810. This may help to ensure that the particles are removed all portions of the screen 810 (e.g., along the length of the screen 810).

After the (e.g., first portion of the) particles are removed from the screen 810, the (e.g., first portion of the) particles may descend through the annulus to the lower end 816 of the pressure vessel 815 (e.g., due to gravity). The now-clean fluid may exit the pressure vessel 815 through the outlet 805. The particles may be removed from the pressure vessel 815 through the drain 825.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus for removing sand from a well fluid, the apparatus comprising:

a pressure vessel having an inlet and an outlet, wherein the well fluid flows into the pressure vessel through the inlet and flows out of the pressure vessel through the outlet;

a screen positioned at least partially within the pressure vessel and configured to remove the sand from the well fluid, wherein at least a portion of the sand that is removed from the well fluid at least partially obstructs one or more openings in the screen; and a cleaning assembly comprising:

a cleaning element positioned at least partially between the pressure vessel and the screen and configured to remove the sand that is obstructing the one or more openings in the screen during a screen-cleaning operation;

a power device configured to rotate the screen around a central longitudinal axis thereof during the screen-cleaning operation, the power device being positioned within the pressurized vessel; and a linear actuator that is configured to move the cleaning element in a linear direction that is parallel to the central longitudinal axis of the screen during the screen-cleaning operation, wherein the linear actuator is positioned adjacent to the power device within the pressurized vessel.

2. The apparatus of claim 1, wherein the central longitudinal axis is substantially vertical.

3. The apparatus of claim 1, wherein the well fluid flows radially-inward through the one or more openings in the screen, wherein the at least a portion of the sand that is removed from the well fluid and least partially obstructs the one or more openings in the screen is positioned on an outer surface of the screen, and wherein the cleaning element is positioned in an annulus between the pressure vessel and the screen.

4. The apparatus of claim 3, wherein the cleaning element includes a spray nozzle assembly that is configured to spray a washing fluid radially-inward onto the outer surface of the screen during the screen-cleaning operation as the power device rotates the screen.

5. The apparatus of claim 1, wherein the cleaning element comprises a brush that is configured to brush the screen during the screen-cleaning operation.

6. The apparatus of claim 5, wherein the linear actuator is configured to move the brush during the screen cleaning operation.

7. The apparatus of claim 1, wherein the cleaning element includes a scraper that is configured to scrape the screen during the screen-cleaning operation.

8. The apparatus of claim 7, wherein the linear actuator is configured to move the scraper during the screen-cleaning operation.

9. An apparatus for removing sand from a well fluid, the apparatus comprising:

a pressure vessel having an inlet and an outlet, wherein the well fluid flows into the pressure vessel through the inlet and flows out of the pressure vessel through the outlet;

a screen positioned at least partially within the pressure vessel, wherein the screen is substantially cylindrical and has a central longitudinal axis extending therethrough, wherein the screen is configured to remove the sand from the well fluid, and wherein at least a portion of the sand that is removed from the well fluid at least partially obstructs one or more openings in the screen; and a cleaning assembly positioned at least partially between the pressure vessel and the screen, wherein the cleaning assembly comprises:

a power device configured to rotate the screen about the central longitudinal axis wherein the power device comprises a motor positioned in the pressure vessel, wherein the pressurized vessel is configured to contain a high-pressure environment of between about 1,000 psi and about 10,000 psi; and a spray nozzle that is configured to spray a washing fluid radially-inward onto an outer surface of the screen as the power device rotates the screen.

10. The apparatus of claim 9, wherein the cleaning assembly also comprises a linear actuator that is configured to move the spray nozzle in a linear direction that is parallel to the central longitudinal axis of the screen as the spray nozzle sprays the washing fluid radially-inward onto the outer surface of the screen, the linear actuator being positioned adjacent to the power device within the pressurized vessel.

11. The apparatus of claim 9, wherein the cleaning assembly further comprises a plurality of nozzles, including the spray nozzle, the plurality of nozzles being axially offset from one another.

12. The apparatus of claim 9, wherein the cleaning assembly is positioned at least partially in an annulus between the pressure vessel and the screen.

13. The apparatus of claim 9, wherein the central longitudinal axis is substantially vertical.

14. The method of claim 9, wherein the motor is an electric motor.

15. A method of removing sand from a screen disposed in a pressure vessel, the method comprising:

causing a well fluid to flow into the pressure vessel, wherein the screen in the pressure vessel removes the sand from the well fluid, and wherein at least a portion of the sand that is removed from the well fluid at least partially obstructs one or more openings in the screen;

removing the sand from the screen using a cleaning assembly that is positioned at least partially between the pressure vessel and the screen;

rotating the screen about a central longitudinal axis that extends therethrough as the sand is removed from the screen, wherein rotating the screen comprises powering a power device positioned in the pressure vessel, such that the power device rotates the screen; and moving the cleaning assembly, using a linear actuator positioned in the pressure vessel and adjacent to the power device, in a linear direction that is parallel to the central longitudinal axis of the screen.

16. The method of claim 15, wherein the cleaning assembly comprises a spray nozzle assembly, and wherein removing the sand from the screen comprises spraying a washing fluid onto an outer surface of the screen with the spray nozzle assembly.

17. The method of claim 15, further comprising determining that the one or more openings in the screen are at least partially obstructed by measuring a pressure drop of the well fluid between an inlet and an outlet of the pressure vessel.

18. The method of claim 15, further comprising determining that the one or more openings in the screen are at least partially obstructed by measuring volumetric flow rate of the well fluid.

* * * * *